United States Patent [19]

Kraynak et al.

[11] 3,982,744

[45]*Sept. 28, 1976

[54] PERSONALIZED COMPUTER PRINTED HARD COVERED BOOK

[75] Inventors: Joseph Stephen Kraynak, Van Nuys, Calif.; Arthur Blumenfield, Eastchester, N.Y.

[73] Assignee: Me-Books Publishing Company, Burbank, Calif.

[ * ] Notice: The portion of the term of this patent subsequent to July 1, 1992, has been disclaimed.

[22] Filed: Mar. 10, 1975

[21] Appl. No.: 557,133

Related U.S. Application Data

[63] Continuation-in-part of Ser. No. 317,016, Dec. 20, 1972, Pat. No. 3,892,427.

[52] U.S. Cl. ..... 270/12; 11/1 R; 197/19; 270/52; 270/54; 281/15 R; 283/63 R

[51] Int. Cl.[2] ..... B41F 13/54

[58] Field of Search..... 281/15 R, 21 R; 83/371, 83/925 A; 270/1, 4, 5, 12, 20, 21, 52–55, 58; 197/19; 101/19, 20, 47, 73, 90, 93 C, 197; 11/1 R, 1 ET; 235/152; 283/63 R

[56] References Cited

UNITED STATES PATENTS

| | | | |
|---|---|---|---|
| 3,070,365 | 12/1962 | Lohrmann | 270/52 |
| 3,166,309 | 1/1965 | Pidgeon | 270/1 |
| 3,284,077 | 11/1966 | Matuschke | 270/5 |
| 3,407,690 | 10/1968 | Stanley | 83/371 X |
| 3,593,987 | 7/1971 | Garber | 270/21 |
| 3,602,114 | 8/1971 | Peters | 270/1 X |
| 3,608,888 | 9/1971 | McCain et al. | 270/54 |
| 3,652,078 | 3/1972 | Sather et al. | 270/58 |
| 3,692,298 | 9/1972 | Peacock | 270/12 |
| 3,730,512 | 5/1973 | Bellanca | 11/1 R |
| 3,892,427 | 7/1975 | Kraynak et al. | 281/15 R |

*Primary Examiner*—Richard C. Pinkham
*Assistant Examiner*—Vance Y. Hum
*Attorney, Agent, or Firm*—Spensley, Horn, & Lubitz

[57] ABSTRACT

A method of preparing a personalized hard covered book having variable and non-variable printed copy which utilizes a computer to print at least the personalized portions of the text.

1 Claim, 4 Drawing Figures

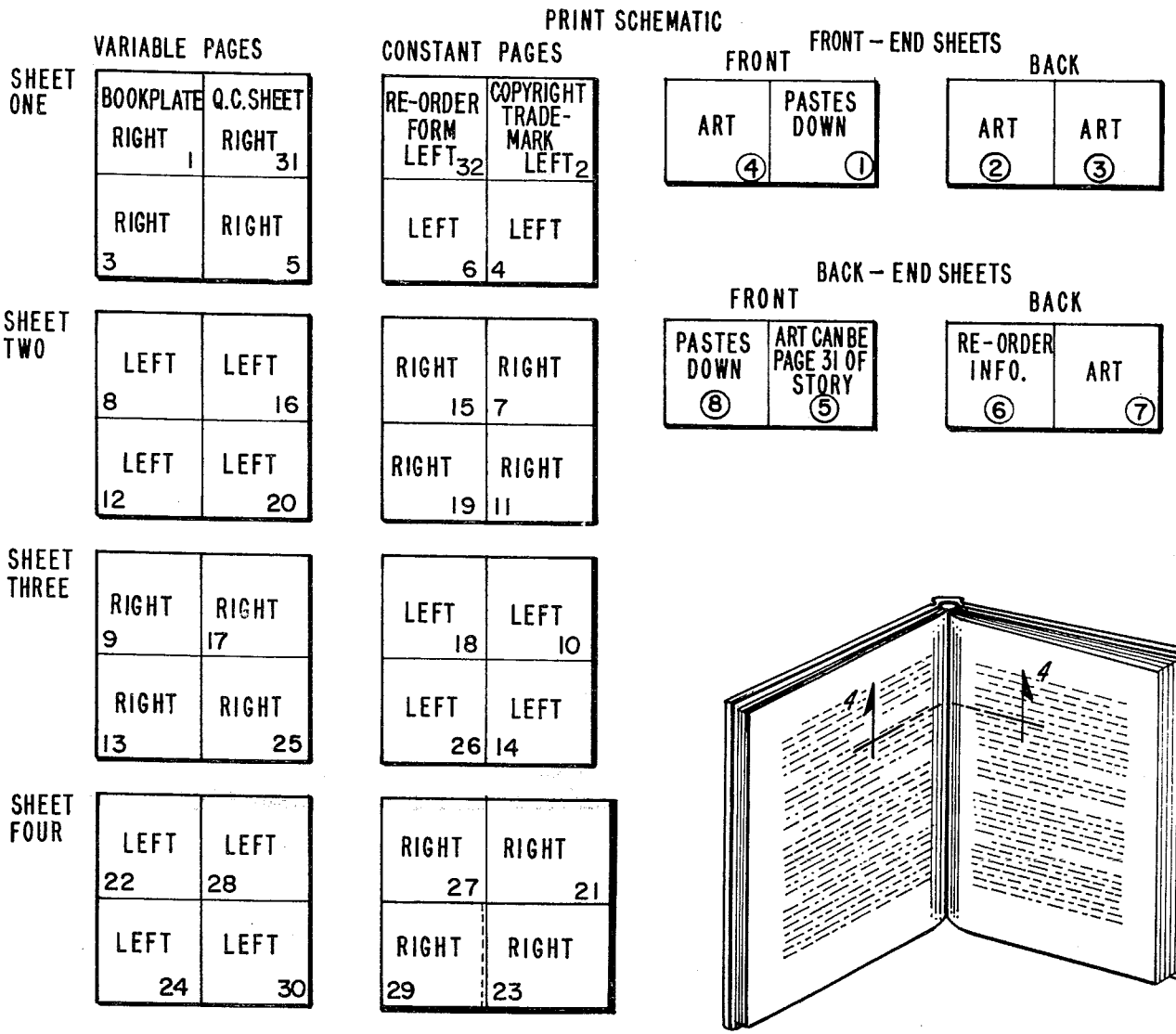
FIG.—2
FIG.—3
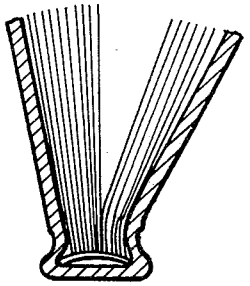
FIG.—4

PERSONALIZED COMPUTER PRINTED HARD COVERED BOOK

This application is a continuation-in-part of application, Ser. No. 317,016, filed Dec. 20, 1972, now U.S. Pat. No. 3,892,427.

This invention relates generally to methods for the manufacture of books. More specifically, it relates to a method of printing personalized books with substantial personalized copy utilizing a computer to print the various personalized data of each copy. A feature of the invention is the method of making such a book wherein the complete printed copy can be bound in a hard cover to form a high quality book. The method according to the invention is particularly advantageous for making children's books of limited length because the child's name, child's street number, best friend and other data of a personal nature can be incorporated in the text.

An object of this invention was to provide a method for forming personalized books that would be economical and yet provide such books of a high quality.

Another object of the invention is the provision of a method for forming personalized books wherein a computer could be utilized to store individual personalized data and then print out on regular computer printing sheet materials a complete copy of the text for such a book.

Another object of the invention was a provision of a method for printing a personalized book wherein proper collation and quality control of the book could be assured.

Still another object of the invention was the provision of a computer printed book produced by a method wherein mailing labels and quality control data would be part of the printed text of the book and would not require separate printing or hand labeling.

BRIEF DESCRIPTION OF THE INVENTION

According to the invention, there is provided a method of preparing a personalized hard covered book having variable and non-variable printed copy which utilizes a computer to print at least the personalized portions of the text. The method includes the steps of preprinting the pages of the book with a non-variable copy, i.e. the copy that will not change from book to book, on continuous form computer printing sheet material. Such material is then introduced to a computer printer which operates in conjunction with a computer wherein there is stored variable data (which is also sometimes termed "source" data) for each copy of the book. The computer printer adds the variable data to the preprinted non-variable copy thus producing the complete copy for an individual book.

A feature of the invention is a method wherein the continuous form computer printing sheet material is preprinted on only one side, and the entire text of the opposite side including variable data and non-variable copy are printed by the computer printer.

Another feature of the invention is the inclusion of quality control data added by the computer printer so that the pages of the book can be properly collated.

DESCRIPTION OF THE DRAWINGS

The invention will be more fully understood with reference to the accompanying drawings wherein:

FIG. 2 is a print schematic showing the arrangement of printed pages of a typical book produced according to the invention;

FIG. 3 is a view in perspective showing a book produced according to the invention; and, FIG. 4 is a cross sectional view taken along line 4—4 of FIG. 3.

DETAILED DESCRIPTION OF THE INVENTION

Figure 1:
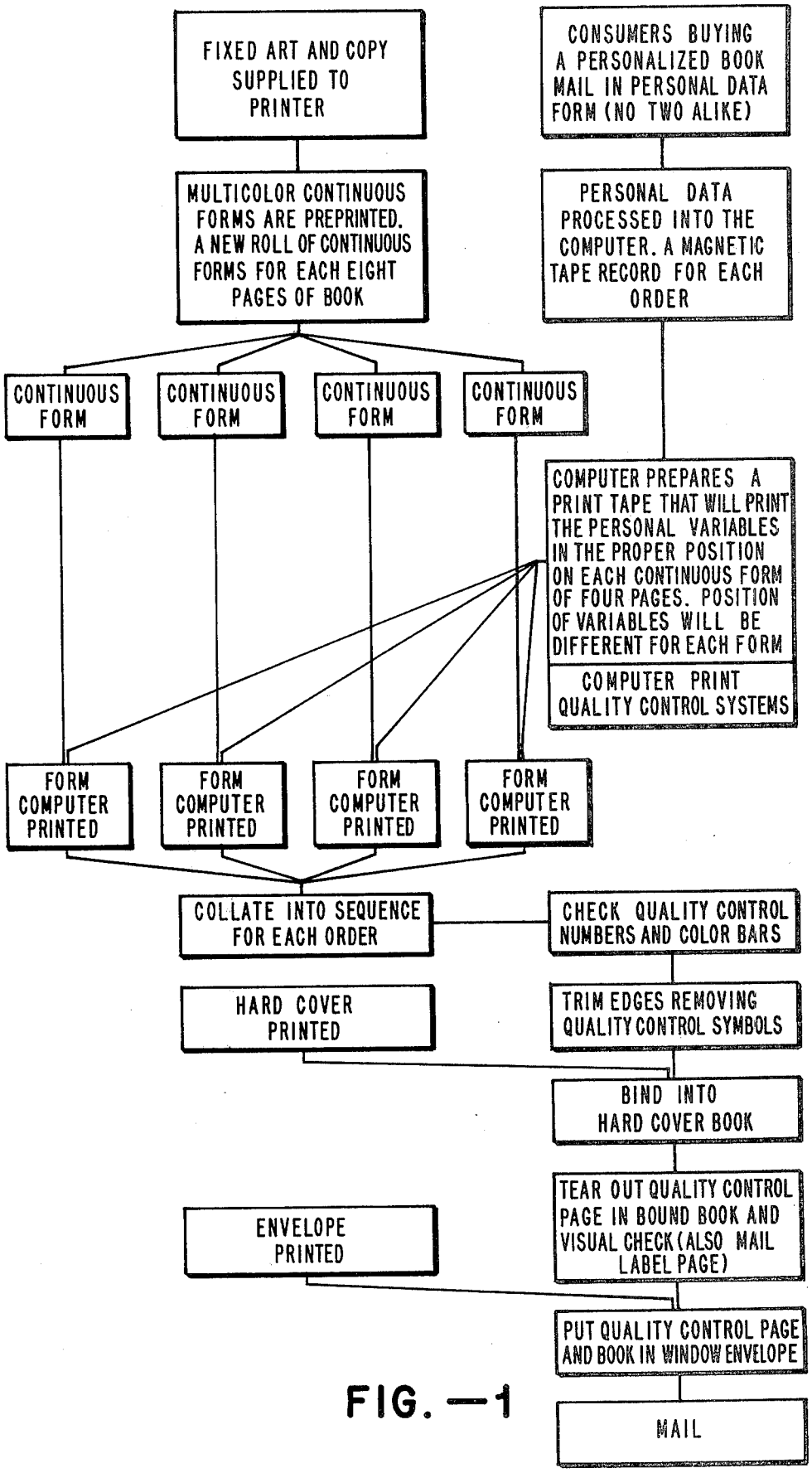
FIG. 1 is a schematic block diagram showing the sequence of events for a preferred method of forming a personalized hard covered book according to the invention.

With reference to the drawings, the following is a detailed description of the invention.

Continuous form computer printing sheets are preprinted with all or a portion of the non-variable text for any given book. In the presently preferred form of the invention non-variable text is preprinted only on the side of the computer printing sheets where there is no variable text. To achieve uniformity of printing both the variable text and the non-variable text are printed by a computer printer on the side of the sheets where both are to appear. The preprinting method may be any method known in the art which can print continuous fan folded computer forms and it is presently preferred to use a web perfecting press method. It is also presently preferred to use a computer printer type style so that the type styles of the non-variable data and the variable data for any given book will appear the same. The preprinted pages may, of course, be preprinted with both text and art work in color or black and white. Of course, art work may be preprinted on either or both sides of the computer printing sheets irrespective of whether the text is preprinted or computer printed.

A typical non-variable text might for example include a story about a child and a dog and the child's best friend. The non-variable text would include all of the events that would take place between the child and dog and the best friend but would not include personalized data of any of them. The personalized variable data for any given child would be collected and inputted to computer storage. Then, the preprinted pages on continuous form computer printing sheet material would be fed into a computer printer and the variable data including the names of the child, his dog and his best friend as well as any other variable data provided for in the book text would be printed in blank spaces on the preprinted form to complete the printed text. In the preferred form of the invention some non-variable data would also be printed by the computer printer.

It will be understood, of course, that many sets of variable data can be stored in a computer and a number of books personalized to conform to the sets of variable data can be produced with the computer printers running continuously.

A feature of the invention is a provision in the method of making a book which will compensate for limitations in computer equipment and paper adapted to be printed by computer printers. Typically, computer printers are limited in the width of the lines of print which they can produce. Therefore, a multiple page book cannot be printed upon a single length of continuous form computer printing material since there is insufficient width on the material to form a plurality of pages of any significant size. It will, of course, be understood that in order to form a number of pages from a single length of computer printed sheet material, the material can only be folded in a horizontal direction. If it were to be folded in a vertical direction, some of the printing would appear upside down. It is therefore preferred according to this invention to use a plurality of printers so that the pages of a book having a relatively large number of pages can all be produced simultaneously. The exact number or printers required will, of course, be determined by the length of the book and the size of the pages. It is currently preferred, however, for a book of standard textbook size having 32 pages to use four computer printers as a preferred example.

Because a plurality of printers are preferably used according to the invention a feature of the invention has been developed which permits the accurate collation of pages from the various individual computer printers. The importance of such a collation step will be realized when it is considered that for purposes of economy the computer printers should run simultaneously and produce printed pages for a large number of individual books in a continuous run. Thus a stack of fan folded continuous form computer printing sheet materials from any given computer printer may contain parts of a multitude of individual books. According to this invention, errors in assembling portions of one book into another are eliminated by utilizing quality control numbers, check bars and portions of the variable data printed on the margins of the continuous form computer printing sheet material in a manner so that either automatic or visual inspection may be used to determine if the pages are properly collated.

According to an improved form of the invention, it is preferred to print the continuous form computer printing sheet materials in a manner such that only odd number pages are on one side and only even number pages on the other side. This technique has been found advantageous as random manual collation can be substituted by mechanical collating techniques.

As a specific example of the collation feature of the invention, a child's first and last names could be printed on a margin of each of the printed sheets and collated in an offset manner so that visual inspection would immediately assure that all of the sheets belonging to any given book were properly in the collation.

It will, of course, be realized that the front and the back of the continuous form sheet material will preferably contain printing so that there will be no blank pages in the completed book. In order to eliminate the necessity to print both sides of the continuous form preprinted computer printing paper, it is preferred of course to lay out the non-variable text material with pages having no variable data all on one side so that only one side of the continuous form paper will have to be printed by the computer printers while printing the variable data.

After the pages are properly collated, they can then be trimmed to remove the quality control numbers, color bars or variable data printed only for quality control purposes on their edges. The pages are then folded and bound into a hard covered book by methods known in the art.

In a presently preferred form of the invention, continuous form computer printing paper is preprinted on one side with both the art work and non-variable text for a 32 page book. The other side of the paper is preprinted with art work only. Included in the text are quality control and mailing label sheets, which may be perforated for easy removal. Large numbers of sets of variable data is inputted to computer storage. The preprinted sheets are then put through four computer printers to produce corresponding large numbers of completely printed books. The continuous form printing sheet material is run through a conventional bursting machine to produce individual sheets approximately 22 inches high. These sheets from each of the four computer printers are then collated to form a collation for each individual book.

These collated and stacked sheets are then subjected to three cutting operations to successively cut off the pin holes on the margins, cut the sheets horizontally to form 11 inch high pages and cut the sheets vertically to form 16 inch divided sheets printed on both sides to comprise the pages of the 32 page book. These sheets are then collated and quality control indicia is inspected to assure the pages all belong to the same book and that they are in the proper order. The pages are then trimmed to final book size and in so doing the quality control and collation indicia are removed from the margins. The individual pages are then bound to a backing sheet and a hard cover by a perfect bind method using a hot melt glue.

The book produced according to the invention can have one or more pages which are perforated so that they can be removed. Such pages can serve as mailing labels and/or quality control sheets.

We claim:

1. The method of preparing a personalized hard cover story book having variable printed data of a personal nature and non-variable printed copy which utilizes a computer to print at least the personalized portions of the text comprising the steps of:

a. preprinting the pages of a book with non-variable copy and art materials on continuous form computer printing sheet material to produce a preprinted continuous form computer printing sheet material;

b. inputting to a computer variable data for each personalized copy of the book;

c. introducing said preprinted continuous form sheet material into a computer printed in a manner such that a complete printed text will be produced for each set of variable data;

d. printing said variable data including quality control indicia on said preprinted continuous form sheet material, said pre-printing step and said printing step producing a printed continuous form sheet material with only odd numbered pages on one side and only even numbered pages on the other side;

e. cutting said continuous form printout materials to a size to form pages;

f. collating the pages from the printer into the proper sequence for each individual personalized book;

g. inspecting the quality control indicia on each of said collated pages to determine that the book is properly collated;

h. trimming away portions of said pages to remove quality control marks therefrom; and, i. binding said pages into a hard cover book.

* * * * *